US012733687B2

(12) United States Patent
Keen et al.

(10) Patent No.: US 12,733,687 B2
(45) Date of Patent: Sep. 15, 2026

(54) ENGAGEMENT INDICATOR SYSTEM

(71) Applicant: Altria Client Services LLC, Richmond, VA (US)

(72) Inventors: Jarrett Keen, Richmond, VA (US); Kevin Ball, Richmond, VA (US); Taylor Witt, Richmond, VA (US); Raymond W. Lau, Glen Allen, VA (US); Zack W. Blackmon, Midlothian, VA (US); Rangaraj S. Sundar, Midlothian, VA (US); Eric Hawes, Glen Allen, VA (US); Terry Bache, Richmond, VA (US); Niall Gallagher, Cambridge (GB)

(73) Assignee: ALTRIA CLIENT SERVICES LLC, Richmond, VA (US)

( * ) Notice: Subject to any disclaimer, the term of this patent is extended or adjusted under 35 U.S.C. 154(b) by 597 days.

(21) Appl. No.: 18/053,133

(22) Filed: Nov. 7, 2022

(65) Prior Publication Data

US 2024/0148074 A1 May 9, 2024

(51) Int. Cl.
*A24F 40/53* (2020.01)
*A24F 40/60* (2020.01)

(52) U.S. Cl.
CPC ..... *A24F 40/53* (2020.01); *A24F 40/60* (2020.01)

(58) Field of Classification Search
None
See application file for complete search history.

(56) References Cited

U.S. PATENT DOCUMENTS

| | | | |
|---|---|---|---|
| 8,550,069 | B2 | 10/2013 | Alelov |
| 8,714,150 | B2 | 5/2014 | Alelov |
| 9,462,832 | B2 | 10/2016 | Lord |
| 10,117,460 | B2 | 11/2018 | Sears et al. |
| 10,342,263 | B2 | 7/2019 | Memari et al. |
| 10,349,675 | B2 | 7/2019 | Choukroun et al. |
| 10,349,679 | B2 | 7/2019 | Memari et al. |
| 10,349,680 | B2 | 7/2019 | Memari et al. |

(Continued)

FOREIGN PATENT DOCUMENTS

| | | | | |
|---|---|---|---|---|
| CN | 112602080 A | * | 4/2021 | ..... G06F 21/32 |
| CN | 115005507 A | | 9/2022 | |

(Continued)

OTHER PUBLICATIONS

João F. Pinto, A Review of Current Pill Organizers and Dispensers, 2021 IEEE 9th International Conference on Serious Games and Applications for Health (SeGAH) (Year: 2021).*

(Continued)

*Primary Examiner* — Jerry O'Connor
*Assistant Examiner* — Matthew H Divelbiss
(74) *Attorney, Agent, or Firm* — Harness, Dickey & Pierce, P.L.C.

(57) ABSTRACT

A system configured to output an indication of engagement with a device. The system includes at least one processor and a memory coupled to the at least one processor. The memory is configured to store instructions. The at least one processor is configured to execute the instructions to cause the system to monitor usage of the device, determine the indication of engagement with the device based on the usage of the device, and output the indication of engagement with the device.

19 Claims, 10 Drawing Sheets

(56) References Cited

U.S. PATENT DOCUMENTS

| | | | |
|---|---|---|---|
| 10,349,681 | B2 | 7/2019 | Memari et al. |
| 10,357,062 | B2 | 7/2019 | Memari et al. |
| 10,362,807 | B2 | 7/2019 | Memari et al. |
| 10,362,808 | B2 | 7/2019 | Memari et al. |
| 10,368,585 | B2 | 8/2019 | Memari et al. |
| 10,375,990 | B2 | 8/2019 | Lord |
| 10,375,998 | B2 | 8/2019 | Memari et al. |
| 10,420,373 | B2 | 9/2019 | Alelov |
| 10,448,670 | B2 | 10/2019 | Talon et al. |
| 10,463,079 | B2 | 11/2019 | Memari et al. |
| 10,517,530 | B2 | 12/2019 | Cohen |
| 10,537,135 | B2 | 1/2020 | Smith et al. |
| 10,617,150 | B2 | 4/2020 | Cameron |
| 10,661,035 | B2 | 5/2020 | Freeman et al. |
| 10,779,568 | B2 | 9/2020 | Smith et al. |
| 10,874,149 | B2 | 12/2020 | Lord |
| 10,980,283 | B2 | 4/2021 | Alelov |
| 11,013,269 | B2 | 5/2021 | Alarcon et al. |
| 11,075,995 | B2 | 7/2021 | Woodbine et al. |
| 11,129,418 | B2 | 9/2021 | Lord |
| 11,147,316 | B2 | 10/2021 | Farine et al. |
| 11,154,095 | B2 | 10/2021 | Alarcon et al. |
| 11,166,495 | B2 | 11/2021 | Cohen |
| 11,219,723 | B2 | 1/2022 | Alelov |
| 11,253,006 | B2 | 2/2022 | Memari et al. |
| 11,259,565 | B2 | 3/2022 | Glaser et al. |
| 11,388,933 | B2 | 7/2022 | Choukroun et al. |
| 11,501,652 | B2 | 11/2022 | Gamygin et al. |
| 2015/0257445 | A1 | 9/2015 | Henry, Jr. et al. |
| 2017/0027229 | A1* | 2/2017 | Cameron ..... H04L 67/12 |
| 2017/0238610 | A1 | 8/2017 | Reevell |
| 2019/0053540 | A1 | 2/2019 | Baker et al. |
| 2019/0087302 | A1 | 3/2019 | Smith et al. |
| 2019/0154258 | A1* | 5/2019 | McDaniel ..... F23Q 2/36 |
| 2019/0183185 | A1 | 6/2019 | Manas et al. |
| 2019/0380389 | A1 | 12/2019 | Hong et al. |
| 2020/0000143 | A1 | 1/2020 | Anderson et al. |
| 2020/0085097 | A1 | 3/2020 | Smith et al. |
| 2020/0152301 | A1 | 5/2020 | Alarcon et al. |
| 2020/0315253 | A1 | 10/2020 | Legendy et al. |
| 2020/0352250 | A1 | 11/2020 | Wood et al. |
| 2020/0390158 | A1 | 12/2020 | Hepworth et al. |
| 2021/0007402 | A1 | 1/2021 | Qiu et al. |
| 2021/0015156 | A1 | 1/2021 | Woodbine et al. |
| 2021/0068464 | A1 | 3/2021 | Lauenstein et al. |
| 2021/0076747 | A1 | 3/2021 | Alarcon |
| 2021/0089946 | A1 | 3/2021 | Pegors et al. |
| 2021/0093015 | A1 | 4/2021 | Lord |
| 2021/0138166 | A1 | 5/2021 | Garcia et al. |
| 2021/0154420 | A1 | 5/2021 | Jorgensen et al. |
| 2021/0161213 | A1 | 6/2021 | Woodbine et al. |
| 2021/0227892 | A1 | 7/2021 | Leah et al. |
| 2021/0235766 | A1 | 8/2021 | Tope |
| 2021/0260308 | A1 | 8/2021 | Marsot et al. |
| 2021/0297489 | A1 | 9/2021 | Woodbine et al. |
| 2021/0313029 | A1 | 10/2021 | Emmett et al. |
| 2021/0337878 | A1 | 11/2021 | Gretton et al. |
| 2021/0378316 | A1 | 12/2021 | Hashimoto |
| 2021/0386122 | A1 | 12/2021 | Lord |
| 2022/0022549 | A1 | 1/2022 | Lin et al. |
| 2022/0047819 | A1 | 2/2022 | Wilson et al. |
| 2022/0053837 | A1 | 2/2022 | Cohen |
| 2022/0061399 | A1 | 3/2022 | Ferrie et al. |
| 2022/0071295 | A1 | 3/2022 | Strophair et al. |
| 2022/0095692 | A1 | 3/2022 | Ferrie et al. |
| 2022/0095697 | A1 | 3/2022 | Greenbaum |
| 2022/0104545 | A1 | 4/2022 | Alsayar et al. |
| 2022/0160050 | A1 | 5/2022 | Carlson et al. |
| 2022/0180769 | A1 | 6/2022 | Pandolfino |
| 2022/0183385 | A1 | 6/2022 | Yilmaz et al. |
| 2022/0287373 | A1 | 9/2022 | Lin et al. |
| 2022/0291257 | A1* | 9/2022 | Laldin ..... G01R 13/0227 |
| 2022/0346458 | A1 | 11/2022 | Zominy |
| 2022/0369721 | A1 | 11/2022 | Choukroun et al. |

FOREIGN PATENT DOCUMENTS

| | | | |
|---|---|---|---|
| EP | 2608686 | B1 | 6/2015 |
| EP | 2797447 | B1 | 7/2017 |
| EP | 2908675 | B1 | 1/2019 |
| EP | 2967145 | B1 | 5/2019 |
| EP | 3416506 | B1 | 4/2020 |
| EP | 3508082 | B1 | 6/2020 |
| EP | 3729983 | A1 | 10/2020 |
| EP | 3275324 | B1 | 11/2020 |
| EP | 3741226 | A1 | 11/2020 |
| EP | 3062643 | B1 | 4/2021 |
| EP | 3508083 | B1 | 7/2021 |
| EP | 3868230 | A2 | 8/2021 |
| EP | 3869503 | A1 | 8/2021 |
| EP | 3878296 | A1 | 9/2021 |
| EP | 3884791 | A2 | 9/2021 |
| EP | 3901893 | A1 | 10/2021 |
| EP | 3932225 | B1 | 6/2022 |
| EP | 3485747 | B1 | 7/2022 |
| EP | 3571941 | B1 | 10/2022 |
| EP | 4074204 | A1 | 10/2022 |
| KR | 20220141275 | A | 10/2022 |
| WO | WO-201756103 | A1 | 4/2017 |
| WO | WO-2019156382 | A1 | 8/2019 |
| WO | 2020234166 | A1 | 11/2020 |
| WO | WO-202174580 | A1 | 4/2021 |
| WO | WO-202174581 | A1 | 4/2021 |
| WO | WO-2021122693 | A1 | 6/2021 |
| WO | WO-2021128071 | A1 | 7/2021 |
| WO | WO-2021250086 | A1 | 12/2021 |
| WO | WO-2021260344 | A1 | 12/2021 |
| WO | WO-2021260345 | A1 | 12/2021 |
| WO | WO-2021260346 | A1 | 12/2021 |
| WO | WO-2021260347 | A1 | 12/2021 |
| WO | WO-202203068 | A1 | 1/2022 |
| WO | WO-202203070 | A1 | 1/2022 |
| WO | WO-202232758 | A1 | 2/2022 |
| WO | WO-202232760 | A1 | 2/2022 |
| WO | WO-202258726 | A1 | 3/2022 |
| WO | WO-202258728 | A1 | 3/2022 |
| WO | WO-202269728 | A1 | 4/2022 |
| WO | WO-2022133611 | A1 | 6/2022 |
| WO | 2022/154867 | A1 | 7/2022 |
| WO | WO-2022158775 | A1 | 7/2022 |
| WO | WO-2022175449 | A1 | 8/2022 |

OTHER PUBLICATIONS

Haussermann Sabine et al: "Smart dry powder inhalers and intelligent adherence management", Advanced Drug Delivery Reviews, vol. 191, Oct. 20, 2022 (Oct. 20, 2022).

International Search Report and Written Opinion Corresponding to Application No. PCT/US2023/078927, mailed Feb. 7, 2024.

Third Party Observation Corresponding to Application No. PCT/US2023/078927, mailed Feb. 25, 2025.

International Preliminary Report on Patentability Corresponding to Application No. PCT/US2023/078927, mailed Apr. 29, 2025.

* cited by examiner

800

| VALUE | # OF CAPSULES (INSERTS) | # OF FLIGHT RECORDER EVENTS (SIZE OF FILE) | AVERAGE PUFFS PER CAPSULE USED |
|---|---|---|---|
| 1 (LOW) | LOWER 20th PERCENTILES | LOWER 20th PERCENTILES | LOWER 20th PERCENTILES |
| 2 | 21st to 39th PERCENTILES | 21st to 39th PERCENTILES | 21st to 39th PERCENTILES |
| 3 (AVG) | 40th to 60th PERCENTILES | 40th to 60th PERCENTILES | 40th to 60th PERCENTILES |
| 4 | 61st to 79th PERCENTILES | 61st to 79th PERCENTILES | 61st to 79th PERCENTILES |
| 5 (HIGH) | UPPER 80th PERCENTILES | UPPER 80th PERCENTILES | UPPER 80th PERCENTILES |

FIG. 8A

850

| INDICATOR | AVERAGE PUFFS/CAPSULE [WEIGHTING = 40%] | TOTAL CAPSULES ACTIVATED [WEIGHTING = 50%] | TOTAL EVENT LOG EVENTS [WEIGHTING = 10%] |
|---|---|---|---|
| 1 | < 5.00 | < 16 | < 20000 |
| 2 | < 8.00 | < 25 | < 30000 |
| 3 | < 11.75 | < 44 | < 50000 |
| 4 | < 18.25 | < 62 | < 70000 |
| 5 | ≥ 18.25 | ≥ 62 | ≥ 70000 |

FIG. 8B

ENGAGEMENT INDICATOR SYSTEM

FIELD

The present disclosure relates to heat-not-burn (HNB) aerosol generating devices and capsules configured to generate an aerosol without involving a substantial pyrolysis of an aerosol-forming substrate.

DESCRIPTION OF RELATED ART

Some electronic devices are configured to heat a plant material to a temperature that is sufficient to release constituents of the plant material while keeping the temperature below a combustion point of the plant material so as to avoid any substantial pyrolysis of the plant material. Such devices may be referred to as aerosol-generating devices (e.g., heat-not-burn aerosol-generating devices), and the plant material heated may be tobacco and/or *cannabis*. In some instances, the plant material may be introduced directly into a heating chamber of an aerosol generating device. In other instances, the plant material may be pre-packaged in individual containers to facilitate insertion and removal from an aerosol-generating device.

BRIEF SUMMARY

New and useful systems, apparatuses, and methods for cooldown alert systems for aerosol-generating devices are set forth in the appended claims. Illustrative embodiments are also provided to enable a person skilled in the art to make and use the claimed subject matter.

For example, in some example embodiments, a system configured to output an indication of engagement with a device is described. The system can include at least one processor and a memory coupled to the at least one processor. The memory can be configured to store instructions. The at least one processor can be configured to execute the instruction to cause the system to monitor usage of the device, determine the indication of engagement with the device based on the usage of the device, and output the indication of engagement with the device.

In some example embodiments, the indication of engagement with the device can include a hex-digit indicator. The hex-digit indicator can include two rows of five hex digits. The hex-digit indicator can encode at least one of a number of capsules used, an average number of puffs per capsule, an exact number of flight recorder events, or a data integrity check. In some example embodiments, the at least one processor can be configured to execute the instructions to cause the device to output the indication of engagement with the device on a communication screen of the device. In some example embodiments, the at least one processor can be configured to execute the instructions to cause the device to output the hex-digit indicator in response to an interaction with the device. In some example embodiments, the last element of the hex-digit indicator can be a single digit. The single digit can represent an overall engagement with the device.

In some example embodiments, the indication of engagement with the device can include a single digit code. The single digit code can be a last digit of a hex-digit indicator. In some example embodiments, the single digit code can represent an overall engagement with the device. In some example embodiments, the at least one processor is configured to determine the overall engagement with the device based on at least one of a number of capsules used, an average number of puffs per capsule, or an exact number of flight recorder events. In some example embodiments, the at least one processor can be configured to execute the instructions to cause the device to output the single digit code on a communication screen of the device. In some example embodiments, the at least one processor can be configured to execute the instructions to cause the device to output the single digit code on the communication screen of the device in response to an interaction with the device. The interaction with the device can include holding a button of the device, opening a lid of the device while the button is being held, closing the lid of the device while the button is being held, and releasing the button. In some example embodiments, the single digit code can be a digit between one and five.

In some example embodiments, the indication of engagement with the device is configured to be monitored remotely.

In some example embodiments, the at least one processor is configured to execute the instructions to adjust the indication of engagement with the device as additional data is gathered by the system.

In some example embodiments, the at least one processor is configured to execute the instructions to scale the indication of engagement with the device to a length of usage. The length of usage can be at least one of two-day usage or seven-day usage.

BRIEF DESCRIPTION OF THE DRAWINGS

The various features and advantages of the non-limiting embodiments herein may become more apparent upon review of the detailed description in conjunction with the accompanying drawings. The accompanying drawings are merely provided for illustrative purposes and should not be interpreted to limit the scope of the claims. The accompanying drawings are not to be considered as drawn to scale unless explicitly noted. For purposes of clarity, various dimensions of the drawings may have been exaggerated.

FIG. 8A is a chart categorizing consumer data into the single-digit icon according to an example embodiment.

FIG. 8B is another chart categorizing consumer data into the single-digit icon according to an example embodiment.

DESCRIPTION OF EXAMPLE EMBODIMENTS

Figure 1:
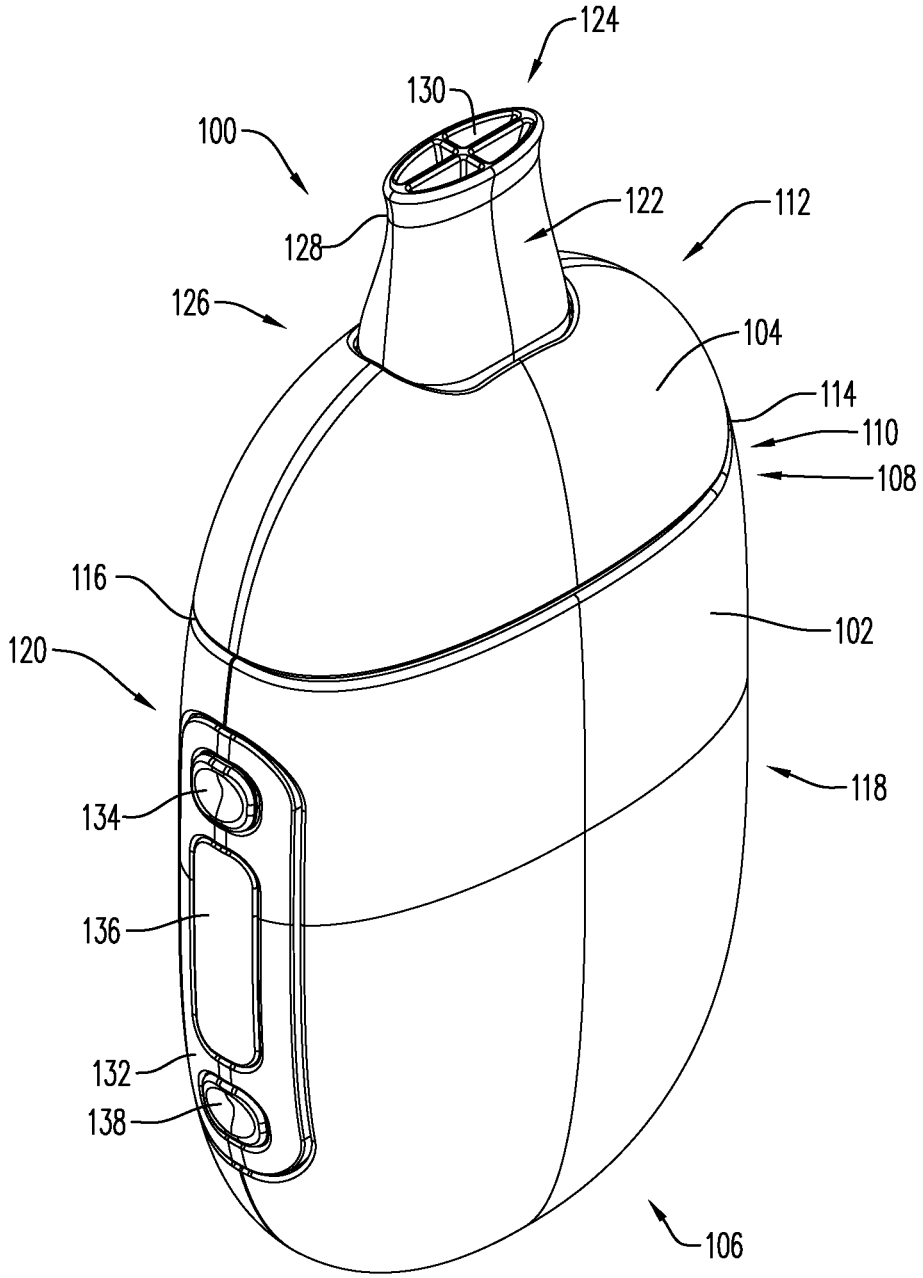
FIG. 1 is a top right, front perspective view of a device in accordance with at least one example embodiment.

Some detailed example embodiments are disclosed herein. However, specific structural and functional details disclosed herein are merely representative for purposes of describing example embodiments. Example embodiments may, however, be embodied in many alternate forms and should not be construed as limited to only the example embodiments set forth herein.

Accordingly, while example embodiments are capable of various modifications and alternative forms, example embodiments thereof are shown by way of example in the drawings and will herein be described in detail. It should be understood, however, that there is no intent to limit example embodiments to the particular forms disclosed, but to the contrary, example embodiments are to cover all modifications, equivalents, and alternatives falling within the scope of example embodiments. Like numbers refer to like elements throughout the description of the figures.

It should be understood that when an element or layer is referred to as being "on," "connected to," "coupled to," or "covering" another element or layer, it may be directly on, connected to, coupled to, or covering the other element or layer or intervening elements or layers may be present. In contrast, when an element is referred to as being "directly on," "directly connected to," or "directly coupled to" another element or layer, there are no intervening elements or layers present. As used herein, the term "and/or" includes any and all combinations of one or more of the associated listed items.

It should be understood that, although the terms first, second, third, etc. may be used herein to describe various elements, regions, layers and/or sections, these elements, regions, layers, and/or sections should not be limited by these terms. These terms are only used to distinguish one element, region, layer, or section from another region, layer, or section. Thus, a first element, component, region, layer, or section discussed below could be termed a second element, region, layer, or section without departing from the teachings of example embodiments.

Spatially relative terms (e.g., "beneath," "below," "lower," "above," "upper," and the like) may be used herein for ease of description to describe one element or feature's relationship to another element(s) or feature(s) as illustrated in the figures. It should be understood that the spatially relative terms are intended to encompass different orientations of the device in use or operation in addition to the orientation depicted in the figures. For example, if the device in the figures is turned over, elements described as "below," or "beneath" other elements or features would then be oriented "above" the other elements or features. Thus, the term "below" may encompass both an orientation of above and below. The device may be otherwise oriented (rotated 90 degrees or at other orientations) and the spatially relative descriptors used herein interpreted accordingly.

The terminology used herein is for the purpose of describing various example embodiments only and is not intended to be limiting of example embodiments. As used herein, the singular forms "a," "an," and "the" are intended to include the plural forms as well, unless the context clearly indicates otherwise. It will be further understood that the terms "includes," "including," "comprises," and/or "comprising," specify the presence of stated features, integers, steps, operations, and/or elements, but do not preclude the presence or addition of one or more other features, integers, steps, operations, elements, and/or groups thereof.

When the terms "about" or "substantially" are used in this specification in connection with a numerical value, it is intended that the associated numerical value includes a manufacturing or operational tolerance (e.g., ±10%) around the stated numerical value. Moreover, when the terms "generally" or "substantially" are used in connection with geometric shapes, it is intended that precision of the geometric shape is not required but that latitude for the shape is within the scope of the disclosure. Furthermore, regardless of whether numerical values or shapes are modified as "about," "generally," or "substantially," it will be understood that these values and shapes should be construed as including a manufacturing or operational tolerance (e.g., ±10%) around the stated numerical values or shapes.

Unless otherwise defined, all terms (including technical and scientific terms) used herein have the same meaning as commonly understood by one of ordinary skill in the art to which example embodiments belong. It will be further understood that terms, including those defined in commonly used dictionaries, should be interpreted as having a meaning that is consistent with their meaning in the context of the relevant art and will not be interpreted in an idealized or overly formal sense unless expressly so defined herein.

As used herein, "coupled" includes both removably coupled and permanently coupled. For example, when an elastic layer and a support layer are removably coupled to one another, the elastic layer and the support layer can be separated upon the application of sufficient force.

Hardware may be implemented using processing or control circuitry such as, but not limited to, one or more processors, one or more Central Processing Units (CPUs), one or more microcontrollers, one or more arithmetic logic units (ALUs), one or more digital signal processors (DSPs), one or more microcomputers, one or more field programmable gate arrays (FPGAs), one or more System-on-Chips (SoCs), one or more programmable logic units (PLUs), one or more microprocessors, one or more Application Specific Integrated Circuits (ASICs), or any other device or devices capable of responding to and executing instructions in a defined manner.

FIGS. 1-4 are illustrations of a device 100 according to some example embodiments. In some embodiments, the device 100 may be an aerosol-generating device (e.g., heat-not-burn (HNB) aerosol-generating device). Referring to FIG. 1, a top perspective view of the device 100 is shown. In some embodiments, a main body of the device 100 may have a general oblong or pebble shape. The main body of the device 100 may include a housing 102 and a lid mechanism or a lid 104. The housing 102 may have a first end 106 and a second end 108 opposite the first end 106. The lid may have a first end 110 and a second end 112 opposite the first end 110. The first end 110 of the lid 104 may be fixedly coupled to the second end 108 of the housing 102 at a first point 114 and releasably couplable to the second end 108 of the housing 102 at a second point 116. The first point 114 of the housing 102 may be on a first side 118 of the device 100. The second point 116 of the housing 102 may be on a second side 120 of the device 100.

In some example embodiments, the device 100 may further include a mouthpiece 122. In at least some example embodiments, the mouthpiece 122 may include a first end 124 and a second end 126 opposite the first end 124. The second end 126 of the mouthpiece 122 may be coupled to the second end 112 of the lid 104. In some embodiments, the second end 126 of the mouthpiece 122 may be releasably coupled to the second end 112 of the lid 104. In at least one example embodiment, the mouthpiece 122 may be tapered between the first end 124 and the second end 126. For example, the diameter or average length/width dimensions of the first end 124 may be smaller than the diameter or average length/width dimensions of the second end 126. Towards the first end 124, the taper may have a slight inward curvature 128 that is configured to receive the lips of an adult consumer and improve the comfort and experience. In some embodiments, the first end 124 may have an oblong or elliptical shape and may include one or more outlets 130. For example, the first end 124 may include four outlets 130, such that four or more different areas or quadrants of the adult consumer's mouth can be engaged during use of the device 100. In other embodiments, the mouthpiece 122 may have fewer outlets than the four outlets 130 or more outlets than the four outlets 130.

In some example embodiments, the housing 102 may include a consumer interface panel 132 disposed on the second side 120 of the device 100. For example, the consumer interface panel 132 may be an oval-shaped panel that runs along the second side 120 of the device 100. The consumer interface panel 132 may include a latch release button 134, as well as a communication screen 136 and/or a control button 138. For example, in at least some example embodiments, the consumer interface panel 132 may include the communication screen 136 disposed between the latch release button 134 and the control button 138. As illustrated, the latch release button 134 may be disposed towards the second end 108 of the device 100, and the control button 138 may be disposed towards the first end 106 of the device 100. The latch release button 134 and the control button 138 may be adult consumer interaction buttons. The latch release button 134 and the control button 138 may have a substantially circular shape with a center depression or dimple configured to direct the pressure applied by the adult consumer, although example embodiments are not limited thereto. The control button 138 may turn on and off the device 100. Though only the two buttons are illustrated, it should be understood more or less buttons may be provided depending on the available features and desired adult consumer interface.

The communication screen 136 may be a user interface such as a human-machine interface (HMI) display. In at least one example embodiment, the communication screen 136 may be an integrated thin-film transistor ("TFT") screen. In other example embodiments, the communication screen 136 is an organic light emitting diode ("OLED") or light emitting diode ("LED") screen. The communication screen 136 is configured for adult consumer engagement and may have a generally oblong shape.

In some embodiments, an exterior of the housing 102 and/or the lid 104 may be formed from a metal (such as aluminum, stainless steel, and the like); an aesthetic, food contact rated plastic (such as, a polycarbonate (PC), acrylonitrile butadiene styrene (ABS) material, liquid crystalline polymer (LCP), a copolyester plastic, or any other suitable polymer and/or plastic); or any combination thereof. The mouthpiece 122 may be similarly formed from a metal (such as aluminum, stainless steel, and the like); an aesthetic, food contact rated plastic (such as, a polycarbonate (PC), acrylonitrile butadiene styrene (ABS) material, liquid crystalline polymer (LCP), a copolyester plastic, or any other suitable polymer and/or plastic); and/or plant-based materials (such as wood, bamboo, and the like). One or more interior surfaces or the housing 102 and/or the lid 104 may be formed from or coated with a high temperature plastic (such as, polyetheretherketone (PEEK), liquid crystal polymer (LCP), or the like).

Figure 2:
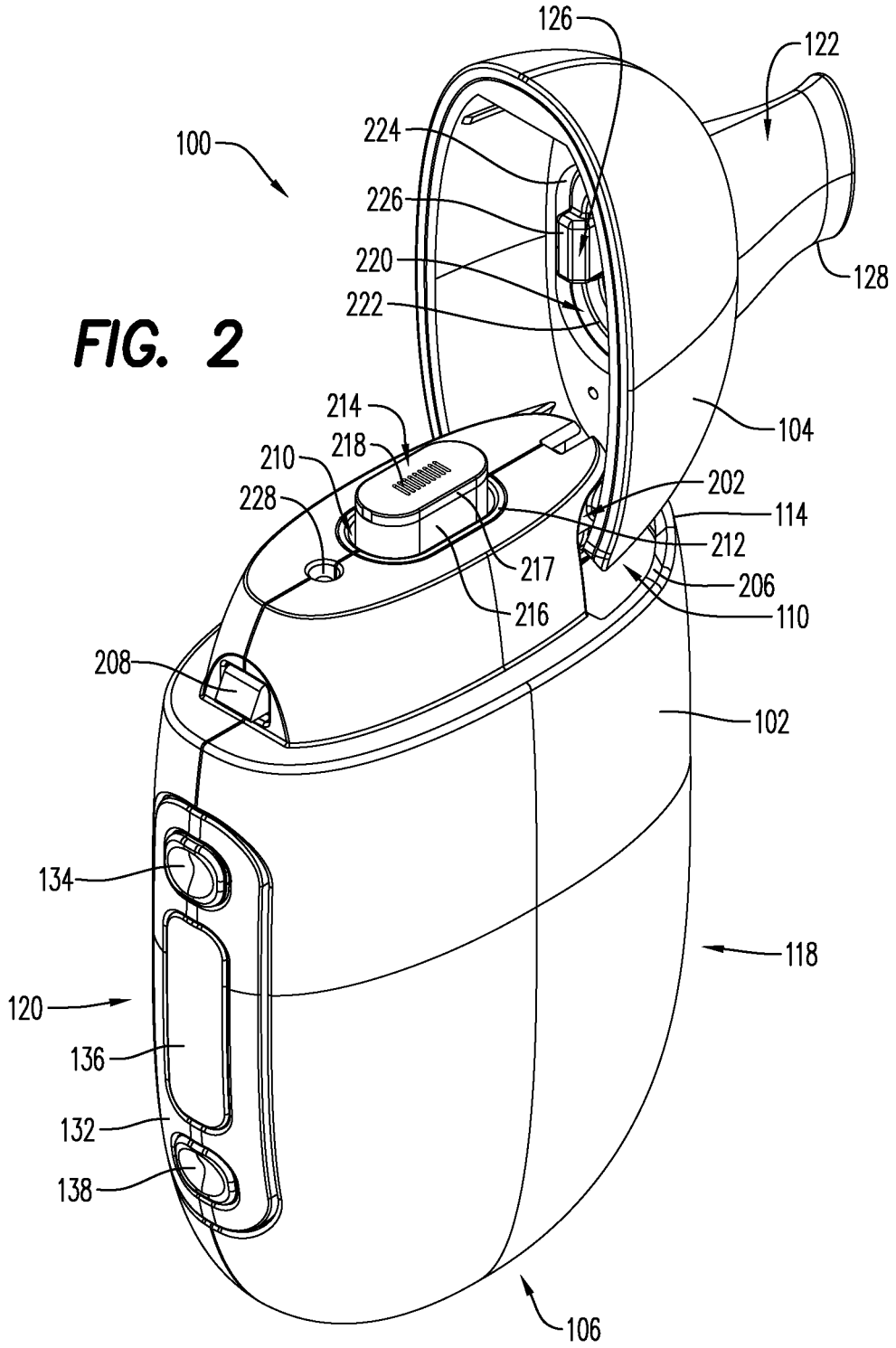
FIG. 2 is a top right, front perspective view of the device, where the lid is opened and where the device includes a capsule.

FIG. 2 shows another top perspective view of the device 100 with the lid 104 in an open configuration. The lid 104 may be fixedly coupled to the housing 102 at the first point 114 by a hinge 202, or other similar connector, that allows the lid 104 to move (e.g., swing and rotate) from an open position to a closed position. In some embodiments, the hinge 202 may be a torsion spring. In at least some example embodiments, the housing 102 may include a recess 204 at the first point 114. The recess 204 may be configured to receive a portion of the lid 104 so as to allow for an easy and smooth movement of the lid 104 from the open position to the closed position (and vice versa). The recess 204 may have a structure that corresponds with a relative portion of the lid 104. For example, as illustrated, the recess 204 may include a substantially curved portion 206 that has a general concave shape that corresponds with the curvature of the lid 104, which has a general convex shape.

The lid 104 may be releasably couplable to the housing 102 at the second point 116 by a latch 208, or other similar connector, that allows the lid 104 to be fixed or secured in the closed position and easily releasable to allow the lid 104 to move from the closed position to the open position. In at least one example embodiment, the latch 208 may be coupled to a latch release mechanism disposed within the housing. The latch release mechanism may be configured to move the latch 208 from a first or closed position to a second or open position.

When the lid 104 is in the open position as shown in FIG. 2, a capsule receiving cavity 210 of the housing 102 is exposed. A capsule connector 212 may define the capsule receiving cavity 210 of the housing 102. In some embodiments, the capsule connector 212 may be mounted or otherwise secured to a printed circuit board (PCB) within the housing 102.

As shown in FIG. 2, a capsule 214 may be received by the capsule receiving cavity 210. In some embodiments, not pictured herein, there may be a gasket disposed around the capsule 214 to help secure the capsule 214 in place within the housing 102. The capsule 214 may include a housing 216 configured to contain an aerosol-forming substrate and a heater. In some embodiments, the housing 216 may be in the form of a cover such as a shell or a box sleeve. In some embodiments, the capsule 214 can include a first end cap 217 and a second end cap. The second end cap may be opposite the first end cap 217 such that is disposed within the housing 102 when the capsule 214 is received by the capsule receiving cavity 210.

As discussed herein, an aerosol-forming substrate or a consumable is a material or combination of materials that may yield an aerosol. An aerosol relates to the matter generated or output by the devices disclosed, claimed, and equivalents thereof. The material may include a compound (e.g., nicotine, cannabinoid), wherein an aerosol including the compound is produced when the material is heated. The heating may be below the combustion temperature so as to produce an aerosol without involving a substantial pyrolysis of the aerosol-forming substrate or the substantial generation of combustion byproducts (if any). Thus, in an example embodiment, pyrolysis does not occur during the heating and resulting production of aerosol. In other instances, there may be some pyrolysis and combustion byproducts, but the extent may be considered relatively minor and/or merely incidental.

The aerosol-forming substrate may be a fibrous material. For instance, the fibrous material may be a botanical material. The fibrous material is configured to release a compound when heated. The compound may be a naturally occurring constituent of the fibrous material. For instance, the fibrous material may be plant material such as tobacco, and the compound released may be nicotine. The term "tobacco" includes any tobacco plant material including tobacco leaf, tobacco plug, reconstituted tobacco, compressed tobacco, shaped tobacco, or powder tobacco, and combinations thereof from one or more species of tobacco plants, such as *Nicotiana rustica* and *Nicotiana tabacum.*

In some example embodiments, the tobacco material may include material from any member of the genus *Nicotiana*. In addition, the tobacco material may include a blend of two or more different tobacco varieties. Examples of suitable types of tobacco materials that may be used include, but are not limited to, flue-cured tobacco, Burley tobacco, Dark tobacco, Maryland tobacco, Oriental tobacco, rare tobacco, specialty tobacco, blends thereof, and the like. The tobacco material may be provided in any suitable form, including, but not limited to, tobacco lamina, processed tobacco materials, such as volume expanded or puffed tobacco, processed tobacco stems, such as cut-rolled or cut-puffed stems, reconstituted tobacco materials, blends thereof, and the like. In some example embodiments, the tobacco material is in the form of a substantially dry tobacco mass. Furthermore, in some instances, the tobacco material may be mixed and/or combined with at least one of propylene glycol, glycerin, sub-combinations thereof, or combinations thereof.

The compound may also be a naturally occurring constituent of a medicinal plant that has a medically-accepted therapeutic effect. For instance, the medicinal plant may be a *cannabis* plant, and the compound may be a cannabinoid. Cannabinoids interact with receptors in the body to produce a wide range of effects. As a result, cannabinoids have been used for a variety of medicinal purposes (e.g., treatment of pain, nausea, epilepsy, psychiatric disorders). The fibrous material may include the leaf and/or flower material from one or more species of *cannabis* plants such as *Cannabis sativa, Cannabis indica*, and *Cannabis ruderalis*. In some instances, the fibrous material is a mixture of 60-80% (e.g., 70%) *Cannabis sativa* and 20-40% (e.g., 30%) *Cannabis* indica.

Examples of cannabinoids include tetrahydrocannabinolic acid (THCA), tetrahydrocannabinol (THC), cannabidiolic acid (CBDA), cannabidiol (CBD), cannabinol (CBN), cannabicyclol (CBL), cannabichromene (CBC), and cannabigerol (CBG). Tetrahydrocannabinolic acid (THCA) is a precursor of tetrahydrocannabinol (THC), while cannabidiolic acid (CBDA) is precursor of cannabidiol (CBD). Tetrahydrocannabinolic acid (THCA) and cannabidiolic acid (CBDA) may be converted to tetrahydrocannabinol (THC) and cannabidiol (CBD), respectively, via heating. In an example embodiment, heat from a heater may cause decarboxylation so as to convert the tetrahydrocannabinolic acid (THCA) in the capsule to tetrahydrocannabinol (THC), and/or to convert the cannabidiolic acid (CBDA) in the capsule to cannabidiol (CBD).

In instances where both tetrahydrocannabinolic acid (THCA) and tetrahydrocannabinol (THC) are present in the capsule, the decarboxylation and resulting conversion will cause a decrease in tetrahydrocannabinolic acid (THCA) and an increase in tetrahydrocannabinol (THC). At least 50% (e.g., at least 87%) of the tetrahydrocannabinolic acid (THCA) may be converted to tetrahydrocannabinol (THC) during the heating of the capsule. Similarly, in instances where both cannabidiolic acid (CBDA) and cannabidiol (CBD) are present in the capsule, the decarboxylation and resulting conversion will cause a decrease in cannabidiolic acid (CBDA) and an increase in cannabidiol (CBD). At least 50% (e.g., at least 87%) of the cannabidiolic acid (CBDA) may be converted to cannabidiol (CBD) during the heating of the capsule.

Furthermore, the compound may be or may additionally include a non-naturally occurring additive that is subsequently introduced into the fibrous material. In one instance, the fibrous material may include at least one of cotton, polyethylene, polyester, rayon, combinations thereof, or the like (e.g., in a form of a gauze). In another instance, the fibrous material may be a cellulose material (e.g., non-tobacco and/or non-*cannabis* material). In either instance, the compound introduced may include nicotine, cannabinoids, and/or flavorants. The flavorants may be from natural sources, such as plant extracts (e.g., tobacco extract, *cannabis* extract), and/or artificial sources. In yet another instance, when the fibrous material includes tobacco and/or *cannabis*, the compound may be or may additionally include one or more flavorants (e.g., menthol, mint, vanilla). Thus, the compound within the aerosol-forming substrate may include naturally occurring constituents and/or non-naturally occurring additives. In this regard, it should be understood that existing levels of the naturally occurring constituents of the aerosol-forming substrate may be increased through supplementation. For example, the existing levels of nicotine in a quantity of tobacco may be increased through supplementation with an extract containing nicotine. Similarly, the existing levels of one or more cannabinoids in a quantity of *cannabis* may be increased through supplementation with an extract containing such cannabinoids.

The first end cap 217 can include a first opening 218. In some embodiments, the first opening 218 may be a series of openings disposed through the first end cap 217. Similarly, the second end cap can include a second opening that may be a series of openings in some embodiments. In some embodiments, the first end cap 217 and/or the second end cap may be transparent so as to serve as windows configured to permit a viewing of the contents/components (e.g., aerosol-forming substrate and/or heater) within the capsule 214.

The capsule receiving cavity 210 may have a base that may be inside the housing 102. In some embodiments, the base may include at least one contact point that may be configured to couple to one or more contact points of the capsule 214 when the capsule 214 is received by the capsule receiving cavity 210. When the capsule 214 is inserted into the capsule receiving cavity 210, the weight of the capsule 214 itself may not be sufficient to compress the at least one contact point of the base of the capsule receiving cavity 210. As a result, the capsule 214 may simply rest on exposed pins of the at least one contact point without any compression (or without any significant compression) of electrical contacts of the at least one contact point. Additionally, the weight of the lid 104 itself, when pivoted to transition to a closed position, may not compress the electrical contacts of the at least one contact point to any significant degree and, instead, may simply rest on the capsule 214 in an intermediate, partially open/closed position. In such an instance, a deliberate action (e.g., downward force) to close the lid 104 will cause a surface 220 of the lid 104 to press down onto the capsule 214 to provide the desired seal and also cause the capsule 214 to compress and, thus, fully engage the electrical contacts of the at least one contact point.

Additionally, a full closure of the lid 104 may result in an engagement with the latch 208, which may maintain the closed position and the desired mechanical/electrical engagements involving the capsule 214 until released (e.g., via the latch release button 134). The force requirement for closing the lid 104 may help to ensure and/or improve air/aerosol sealing and to provide a more robust electrical connection, as well as improved device and thermal efficiency and battery life by reducing or eliminating early power draws and/or parasitic heating of the capsule 214.

The lid 104 may include an inner cavity 222 that may be adapted to receive the housing 102 when the lid is in the closed position. In some embodiments, the inner cavity 222 of the lid 104 may include an impingement or engagement member or the surface 220 configured to engage the capsule 214 when the lid 104 is pivoted to transition to the closed position. The surface 220 of the lid 104 may include a recess that may correspond to the size and shape of the capsule and/or a resilient material to enhance an interface with the capsule to provide the desired seal. In some embodiments, the lid 104 may further include an opening 224 that may be adapted to receive the second end 126 of the mouthpiece 122. The mouthpiece 122 may include at least one extension 226 that may be received by the opening 224 of the lid 104 to secure the mouthpiece 122 to the lid 104. In some embodiments, the lid 104 may further include a projection that may be configured to couple with a recess 228 of the housing 102. The projection may fit within the recess 228 when the lid 104 is coupled to the housing 102 in the closed position.

Figure 3:
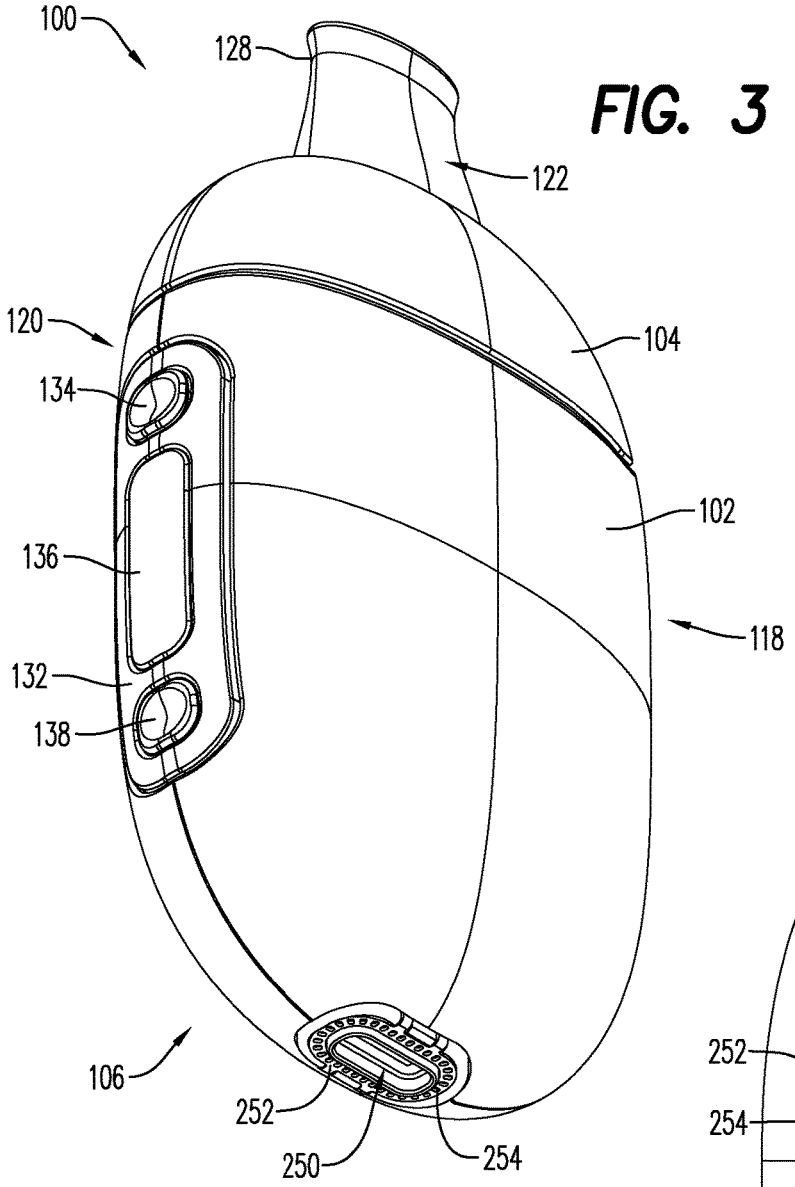
FIG. 3 is a bottom perspective view of the device.

Referring to FIG. 3, a bottom perspective view of the device 100 is shown. In some embodiments, the housing 102 may define a port or a charging connector 250. The charging connector may be defined or disposed the first end 106 of the housing 102. The charging connector 250 may be configured to receive an electric current (e.g., via a USB/mini-USB cable) from an external power source so as to charge a power source internal to the device 100. In some embodiments, a protective grille 252 is disposed around the charging connector 250. The protective grille 252 may be configured to help reduce or prevent debris ingress and/or the inadvertent blockage of the incoming airflow. For example, the protective grille 252 may define a plurality of pores 254 along its length or course. As illustrated, the protective grille 252 may have an annular form that surrounds the charging connector 250. In this regard, the pores 254 may also be arranged (e.g., in a serial arrangement) around the charging connector 250. Each of the pores 254 may have an oval or circular shape, although not limited thereto. In at least one example embodiment, the protective grille 252 may include an approved food contact material. For example, the protective grille 252 may include plastic, metal (e.g., stainless steel, aluminum), or any combination thereof. In at least one example embodiment, a surface of the protective grille 252 may be coated, for example with a thin layer of plastic, and/or anodized.

The pores 254 in the protective grille 252 may function as inlets for air drawn into the device 100. During the operation of the device 100, ambient air entering through the pores 254 in the protective grille 252 around the charging connector 250 will converge to form a combined flow that then travels to the capsule 214. For example, the pores 254 may be in fluidic communication with the capsule receiving cavity 210. In at least one example embodiment, air may be drawn from the pores 254 and through the capsule receiving cavity 210. For example, air may be drawn through the capsule 214 received by the capsule receiving cavity 210 and out of the mouthpiece 122.

Figure 4:
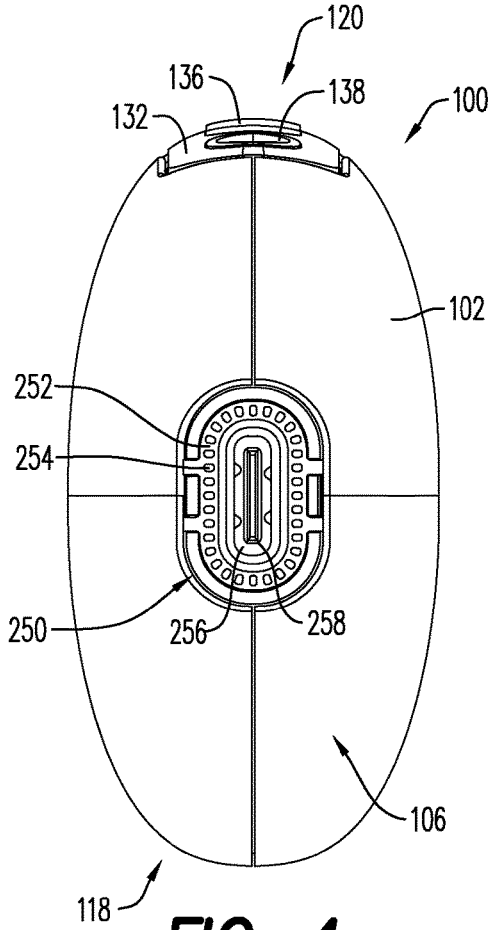
FIG. 4 is a bottom-up view of the device.

Referring to FIG. 4, a bottom-up view of the device 100 is shown. In some embodiments, the charging connector 250 may be an assembly defining a cavity 256 that has a projection 258 within the cavity 256. In at least one example embodiment, the projection 258 does not extend beyond the rim of the cavity 256. In addition, the charging connector 250 may also be configured to send data to and/or receive data (e.g., via a USB/mini-USB cable) from another aerosol generating device (e.g., heat not-burn (HNB) aerosol generating device) and/or other electronic device (e.g., phone, tablet, computer, and the like). In at least one embodiment, the device 100 may instead or additionally be configured for wireless communication (e.g., via Bluetooth) with such other aerosol generating devices and/or electronic devices.

As should be understood, the device 100 and the capsule 214 include additional components (e.g., heater and internal air flow path) such as described in "HEAT-NOT-BURN (HNB) AEROSOL-GENERATING DEVICES AND CAPSULES", filed on Sep. 19, 2022 and assigned application Ser. No. 17/947,436, the entire contents of which are herein incorporated by reference.

Figure 5:
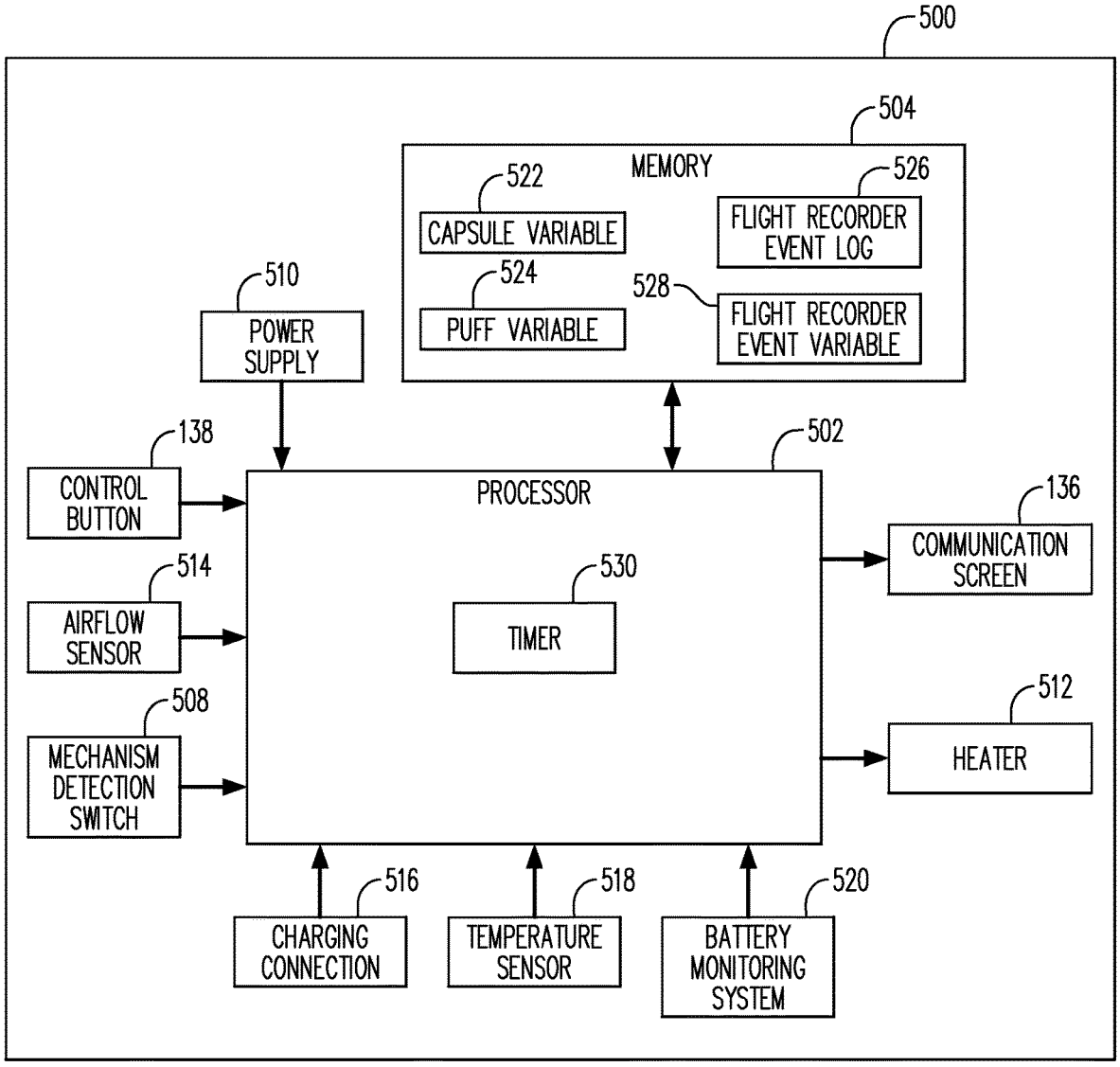
FIG. 5 is a block diagram of an engagement indicator system of the device according to an example embodiment.

Referring to FIG. 5, a block diagram of an engagement indicator system 500 of the device 100 according to an example embodiment is shown. In some embodiments, the engagement indicator system 500 may be configured to monitor usage of the device 100 to determine a consumer's engagement with the device 100. The engagement indicator system 500 may further be configured to output an indication of engagement with the device 100. In some embodiments, an indication of engagement of the device 100 may provide an indication of at least one of a number of capsules used or heated, an average number of puffs per capsule, an exact number of flight recorder events, and/or a data integrity check of the device 100.

The engagement indicator system 500 may include a processor 502, a memory 504, the control button 138, a mechanism detection switch 508, a power supply 510, the communication screen 136, a heater 512, an airflow sensor 514, a charging connection 516, a temperature sensor 518, and a battery monitoring system 520. In some embodiments, the memory 504 may include a capsule variable 522, a puff variable 524, a flight recorder event log 526, and a flight recorder event variable 528. The processor 502 may include a timer 530. In other embodiments, the capsule variable 522, the puff variable 524, the flight recorder event log 526, and the flight recorder event variable 528 may be stored in the processor 502 such as in local storage of the processor 502 and the timer 530 may be executed using instructions stored in the memory 504. In some embodiments, the processor 502 may include the memory 504. The processor 502 may communicate with the memory 504, the control button 138, the mechanism detection switch 508, the power supply 510, the communication screen 136, the heater 512, the airflow sensor 514, the charging connection 516, the temperature sensor 518, and the battery monitoring system 520.

The processor 502 may be hardware including logic circuits, a hardware/software combination that may be configured to execute software, or a combination thereof. For example, the processor 502 may include, but is not limited to, a central processing unit (CPU), an arithmetic logic unit (ALU), a digital signal processor, a microcomputer, a field programmable gate array (FPGA), a System-on-Chip (SoC), a programmable logic unit, a microprocessor, application-specific integrated circuit (ASIC), or another similar device.

The processor 502 may be configured as a special purpose machine (e.g., a processing device) to execute the software or instructions, stored in the memory 504. The software may be embodied as program code including instructions for performing and/or controlling any or all operations described herein as being performed by the processor 502.

In other example embodiments, other processing circuitry and/or control circuitry may be used.

The memory 504 is illustrated as being external to the processor 502, in some example embodiments the memory 504 may be on board the processor 502. The memory 504 may describe any of the terms "storage medium", "computer readable storage medium" or "non-transitory computer readable storage medium" and may represent one or more devices for storing data, including read only memory (ROM), random access memory (RAM), magnetic RAM, core memory, magnetic disk storage mediums, optical storage mediums, flash memory devices and/or other tangible machine-readable mediums for storing information. The term "computer-readable medium" may include, but is not limited to, portable or fixed storage devices, optical storage devices, and various other mediums capable of storing, containing, or carrying instructions and/or data.

The capsule variable 522 may be a counter that represents the number of capsules used. The capsule variable 522 may be set to zero when the device 100 is new and has not been used by a consumer. The capsule variable 522 may be incremented by one each time that a capsule is detected. A capsule may be detected by the device 100 when the capsule has been heated for at least 10 seconds. In some embodiments, the timer 530 may be started by the processor 502 when the heater 512 is supplied with power. Once the timer 530 reaches ten seconds, the capsule variable 522 may be incremented by one.

The puff variable 524 may be a counter that represents a number of puffs taken. The puff variable 524 may be set to zero when a session ends such that the puff variable 524 may measure the number of puffs taken by a consumer each time a capsule is activated. The puff variable 524 may be incremented by one each time that a puff is detected. A puff may be detected when a consumer applies a negative pressure through the mouthpiece 122 of the device 100 after placing his or her mouth over the mouthpiece 122 of the device 100. In some embodiments, the puff variable 524 may be configured to store the number of puffs taken per capsule and to store an average number of puffs taken per capsule. In some embodiments the processor 502 and/or the memory 504 may be configured to calculate the average number of puffs taken per capsule. In some embodiments, the average number of puffs taken per capsule may be updated each time a capsule is inserted into the device 100 and is activated as described above.

The flight recorder event log 526 may be configured to log events of the device 100. For example, the flight recorder event log 526 may log when the device 100 is plugged into a charger and/or removed from a charger, when the lid 104 is opened and/or closed, when a capsule is inserted into the device 100, when a session is started and/or ended, and when the control button 138 and/or the latch release button 134 is pressed. Additional events that may be recorded in the flight recorder event log 526 are listed in the chart below. In some embodiments, the flight recorder event log 526 may be configured to record over one hundred different interactions with the device 100. The flight recorder event variable 528 may be a counter that represents the number of events listed in the flight recorder event log 526. The flight recorder event variable 528 may be incremented by one each time that a new event is added to the flight recorder event log 526.

CHART 1

| Events Logged in the Flight Recorder Event Log | | | |
|---|---|---|---|
| Connecting or disconnecting s Bluetooth radio connection | Receiving a Bluetooth request to Pair | Accepting a Bluetooth pairing request | Detecting movement of a device towards a consumer's mouth |
| Consumable or pod is empty | Unable to read configuration settings for the consumable | A checksum for consumable configuration settings has failed | A general hardware fault has occurred in the consumable |
| A flow/puff sensor of the device has a fault | A charger detects that a battery temperature is too high | A charger could not charge the battery | A heater current and/or voltage exceeds a maximum rating defined for the consumable. |
| A battery current needed to drive a target heater power exceeded a battery limit | A temperature of the consumable heater exceeded a configured maximum temperature and a device shutoff mode was enabled | The device detected a current flowing to the heater when a Vaping task was in an "off" state | A charging current exceeding a maximum rated charge current for the battery |
| A battery temperature has exceeded a maximum temperature for normal discharge operation | A flow/puff sensor has a calibration failure and cannot be used | The consumable is too cold or too hot for the airflow sensor to operate | The airflow sensor is outside its operating window and may be producing inaccurate readings |

CHART 1-continued

| Events Logged in the Flight Recorder Event Log | | | |
|---|---|---|---|
| A flow/puff sensor is not detected | A flow/puff sensor has an unspecified hardware fault and cannot be used | The device received a request to erase Flash storage used for a Firmware Image A or a Firmware Image B | A battery charger has been activated |
| A battery voltage has reached its maximum permitted value | A battery charger chipset indicated that it had exceeded its maximum rated temperature | The consumable has been removed from the device | A puff was ended by the device because it was longer than the permitted maximum puff duration |
| A flow/puff sensor is not supported and cannot be used | A flow/puff sensor has saturated at an upper limit or a lower limit and any output reading is capped | The airflow sensor is producing unstable readings | Configuration data for the airflow sensor does not match the hardware and cannot be used |
| A consumer attempted to turn on the device when it was in a locked state | The device has started a preheat of the consumable | The temperature sensor has developed a fault and cannot be used | The device has detected a puff |
| An IR sensor hardware emissivity value is out of range | The airflow sensor could not be started | A thermocouple reader could not be accessed | An initial heater resistance measurement exceeded the configured upper limit |
| The device detected a potential consumable insertion and has started an integrity check process | An integrity check process did not detect a valid consumable | A battery voltage is too low to drive a target heater power. | The device could not supply enough power to the heater to reach the minimum power level needed for an accurate resistance measurement |
| A battery charger chipset reported a generic hardware fault | A heater power was above the specified mask limit for longer than 90 s in a previous session | The consumable reached the target temperature earlier than expected causing the power to be backed off | The device determined that a heater resistance was above or below the configured maximum |
| PID settings and temperature control mode used to configure a closed loop controller for the heating phase that is about to start | Report indicating a maximum positive or negative mismatch between a measure temperature and a temperature predicted by a heating engine anomaly subsystem using a simple power input | Information that uniquely identifies a device hardware platform | Configuration information for a programmable session configuration |
| A value configured on the device to link log data to a test participant, to a test station, or to a specific test session | A download of an event log has been completed | The device detected a heater temperature exceeded a configured high temperature shutoff absolute temperature threshold | The device detected that a relative change in heater resistance exceeded a high temperature shutoff threshold |

CHART 1-continued

| Events Logged in the Flight Recorder Event Log | | | |
|---|---|---|---|
| The device detected that a change in heater resistance over a previous 64 ms window exceeded a high temperature shutoff threshold | Topography metrics calculated on-device for a previous puff | An integrity check process completed successfully indicating that a heater was present | Values configured on the device to link log data to a specific consumable type |
| A state transition has occurred in a consumable manager state machine | A playlist ID for a playlist displayed on the device at a particular instant | A remaining session level percentage | Time series data recording key variables, including electric variables and performance variables, from a heating subsystem, including current airflow and temperature estimate |
| Key datapoints associated with operation of a hardware battery gas gauge chipset | Values configured on the device to link log data to a specific consumable type | A session has crossed a software defined threshold | A state transition has occurred in a vaping manager state machine |
| A cumulative running error between power target and power output during an initial preheat phase of a session | A boot event was detected that was caused by a restart event | Resistance values recorded during an integrity check course-fine check performed as a preheat is initiated | Time that a power output exceeded a configured power mask |
| Values configured on the device that define key operating parameters for a consumable heater | A 10 character hex-digit code displayed on the communication screen of the device | Time series data recording raw pressure sensor data from the pressure sensor hardware and key calculated variables from the flow processing algorithm | A successful consumable insertion was detected |
| A state transition has occurred in a device manager state machine | A current puff has been completed | On-product settings used to configure aspects of a heating profile used | Device manager settings have been changed |
| Time series data recording raw quaternion data from inertial sensor hardware | Time series data recording raw acceleration data from accelerometer sensor hardware | Time series data replicating data being streamed top an engineering app graphing function via Bluetooth | A timestamp event has been inserted in the event log |
| A boot event was detected that was caused by a power loss event | Tracking variable for consumables where consumption is calculated across intermittent use | Tracking variables for integrated device battery | Time series data for key aerosol generation variables |
| Temperature data recorded by an integrated device temperature sensor and a temperature sensor integrated into the consumable | System is receiving a firmware download via Bluetooth or USB serial interface | System has received a request to activate Firmware | A requested log erase has been completed |

CHART 1-continued

| Events Logged in the Flight Recorder Event Log | | | |
|---|---|---|---|
| A battery charging process has stopped | Configuration information for a programmable session configuration | Values configured on the device that define power setpoints and temperature setpoints for a consumable heater | An event triggered by a consumer interaction |
| A reference resistance used as a baseline for a resistance based temperature control algorithm | Time series data recording flow values at 10 ms intervals to enable high fidelity inspection of flow characteristics | A change on an external general purpose input has been detected | Time series data recording thermocouple readings from integrated thermocouple readers |
| Time series data for key aerosol generation variables logged at 50 ms and 200 ms during puff phases and 500 ms during preheat phases | Resistance measured when the system reached the precision measurement power for a last puff or preheat event | Values configured on the device that define operating points for a puff/flow sensor integrated into the consumable | Values configured on the device that define contents of a consumable |
| An emissivity setting written to an IR sensor chipset and used for temperature calibration | Ambient temperature read from an IR sensor chipset | A time the device sent in low power mode before a last "on" event | A peak temperature recorded in a previous puff phase |
| A heating engine anomaly detection subsystem has detected an anomaly | Report indicating a maximum positive mismatch between a measured temperature and a temperature predicted by a heating engine anomaly subsystem using airflow and conduction losses and a power input | Periodic logging of battery charging process | |

In some embodiments, the capsule variable 522, the puff variable 524, the flight recorder event log 526, and the flight recorder event variable 528 may be stored in a local memory that may be part of the memory 504 or the processor 502. In some embodiments, because these metrics are stored in local memory, they will be preserved in the event of a complete battery discharge. Additionally, the capsule variable 522, the puff variable 524, the flight recorder event log 526, and the flight recorder event variable 528 may not be reset to zero unless the device 100 is reset to a factory default state. The device 100 may be reset to a factory default state at a start of a device research session in some embodiments.

The control button 138 may be configured to generate a signal indicating that a consumer has turned the device 100 to an "on" state if the device 100 was previously in an "off" state or to an "off" state if the device 100 was previously in an "on" state. The control button 138 may additionally be pressed as part of a series of interactions with the device 100 to display a message on the communication screen 136. For example, a consumer may press the control button 138 and complete additional interactions with the device 100 to display an indication of engagement with the device 100 on the communication screen 136.

The mechanism detection switch 508 may be configured to generate a signal indicating that a lid mechanism such as the lid 104 of the device 100 has been opened. The mechanism detection switch 508 may be a push button switch, a toggle button, a capacitive sensor, an IR sensor, a magnetic detection sensor such as a Hall Effect sensor, or another element that is configured to communicate with the processor 502 that the lid 104 of the device 100 has been opened. When the lid 104 of the device 100 is opened, any ongoing session of the device 100 may end. The mechanism detection switch 508 may be configured to generate the signal indicating that the lid 104 has been opened when the latch release mechanism of the device 100 releases the latch 208. Additionally or alternatively, the mechanism detection switch 508 may be coupled to the latch release button 134 and may generate the signal indicating that the lid 104 of the device 100 has been opened when the latch release button 134 is pressed. More specifically, the mechanism detection switch 508 may be located within the recess 228 such that closing the lid 104 of the device 100 actuates the mechanism detection switch 508.

In some embodiments, the housing 102 of the device 100 may enclose or house the power supply 510. The power supply 510 may include one or more batteries such as a rechargeable dual battery arrangement, a lithium-ion battery, and/or fuel cells. The power supply 510 may be configured to receive the electric current supplied to the device 100 through the port to charge the power supply 510. The battery monitoring system 520 may generate a signal indicating that the device 100 has entered a low battery state when the power supply 510 reaches a charge that is lower than a predetermined threshold.

The communication screen 136 may display information related to the device 100. The communication screen 136 may display one or more icons to communicate information related to the device 100. For example, the communication screen 136 may display one or more engagement indicator icons. In some embodiments, the engagement indicator icon may be a single digit code or a hex digit code.

The heater 512 may be housed within the device 100 and may be configured to heat the capsule 214 of the device 100. In some embodiments, the heater 512 may be an element of or may be coupled to one or more of a heating voltage measurement circuit, a heating current measurement circuit, and/or a compensation measurement circuit substantially as described in U.S. application Ser. No. 17/151,409 titled "HEAT-NOT-BURN (HNB) AEROSOL-GENERATING DEVICES INCLUDING INTRA-DRAW HEATER CONTROL, AND METHODS OF CONTROLLING A HEATER" filed on Jan. 18, 2021, the disclosure of which is incorporated herein in its entirety by reference.

The airflow sensor 514 may be configured to detect and/or measure characteristics of airflow through the device 100. For example, the airflow sensor 514 may be configured to detect when air is flowing through the device 100. In at least one example embodiment, the airflow sensor 514 may be a microelectromechanical system (MEMS) flow or pressure sensor or another type of sensor configured to measure air flow such as a hot-wire anemometer. In other embodiments, the airflow sensor 514 may be another known sensor. The airflow sensor 514 may be operated as a puff sensor by detecting a draw with a flow value greater than or equal to about 1 mL/s, and terminating a draw when the flow value subsequently drops to about 0 mL/s. In an example embodiment, the airflow sensor 514 may be a MEMS flow sensor based differential pressure sensor with the differential pressure (in Pascals) converted to an instantaneous flow reading (in mL/s) using a curve fitting calibration function or a Look Up Table (of flow values for each differential pressure reading). In another example embodiment, the flow sensor may be a capacitive pressure drop sensor.

In some embodiments, the airflow sensor 514 may be communicatively coupled with the processor 502 such that the processor 502 is configured to measure a length of time that airflow is flowing through the device 100. It should be understood that while it may be stated that the airflow sensor 514 detects a puff, it may be the processor 502 detecting a signal received from the airflow sensor 514 that detects that a puff has been taken. In some embodiments, a puff may be detected when a negative pressure is detected through the mouthpiece 122 of the device 100.

The charging connection 516 may be configured to generate a signal indicating that the device 100 is connected to a charger. In some embodiments, the housing 102 of the device 100 may include a charging connector or port such as the charging connector 250. For example, the port may be defined/disposed in the first end 106 of the housing 102. The port may be configured to receive an electric current (e.g., via a USB/mini-USB cable) from an external power source to charge a power source such as the power supply 510 internal to the device 100. The charging connection 516 may be configured to detect when the port of the device 100 is receiving an electric current.

The temperature sensor 518 may be configured to measure a temperature of the device 100. In some embodiments, the temperature sensor 518 may be a thermistor or thermocouple. More specifically, the temperature sensor 518 may be disposed proximate to the capsule 214 of the device 100 and may be configured to measure a temperature of the of an area proximate to the capsule 214 of the device 100 to determine when the capsule 214 may be removed from the device 100.

The battery monitoring system 520 may be configured to generate a signal indicating that the device 100 has entered a low battery state.

Figure 6:
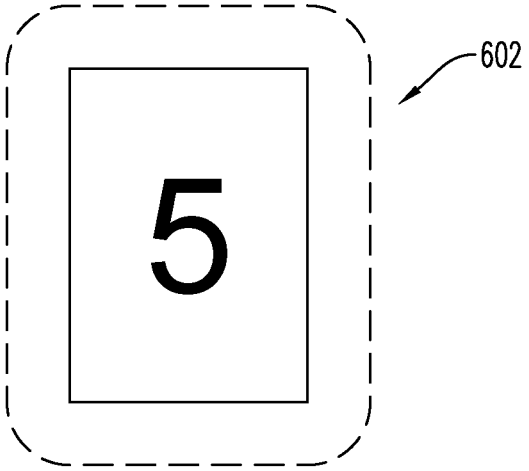
FIG. 6 is a single-digit icon representing an indication of engagement with the device according to an example embodiment.

Referring to FIG. 6, a single digit code 602 is shown. The single digit code 602 may be displayed on the communication screen 136 by the processor 502 as an output of an indicator of engagement with the device. The single digit code 602 may represent an overall indication of engagement with the device 100. In some embodiments, the single digit code 602 may be scaled based on a length of usage of the device 100. For example, the length of usage may be two-day usage or seven-day usage or another length of time. For example, the single digit code 602 may be a digit ranging from one (1) to five (5). The lower the digit, the less engaged with the device 100 the consumer may be. For example, a 1 may indicate a low engagement level while a 5 may indicate a high engagement level and a 3 may indicate an average engagement level. The processor 502 may determine the single digit code at least from the capsule variable 522, the puff variable 524, and the flight recorder event variable 528. In some embodiments, additional metrics may be monitored and used to determine the single digit code 602.

Figure 7A:
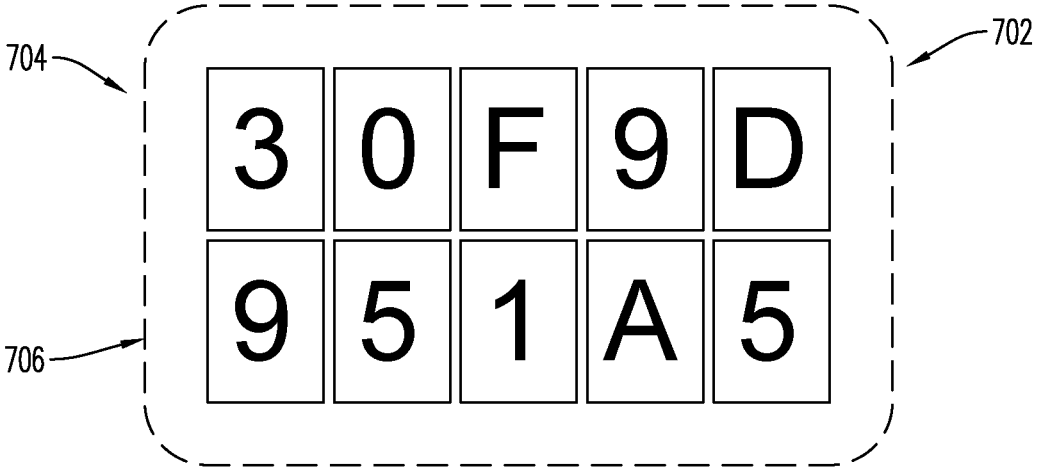
FIG. 7A is a hex-digit icon representing an indication of engagement with the device according to an example embodiment.

Referring to FIG. 7A, a hex-digit code 702 is shown. The hex-digit code 702 may be displayed on the communication screen 136 by the processor 502 as an output of an indicator of engagement with the device. The hex-digit code 702 may be a ten hex-digit code. In some embodiments, the hex-digit code 702 may be displayed as two rows of five elements such as a first row 704 and a second row 706. Each element may be either a letter from A to F or a number from zero (0) to nine (9). Each element of the hex-digit code 702 may represent a metric associated with usage of the device 100. In some embodiments, the hex-digit code 702 may be scaled based on a length of usage of the device 100. For example, the length of usage may be two-day usage or seven-day usage or another length of time. In some embodiments, the capsule variable 522, the puff variable 524, and the flight recorder event variable 528 may be represented by elements of the hex-digit code, respectively, or maybe represented by a single element or two elements.

In some embodiments, any of the first nine elements of the hex-digit code 702 may represent the capsule variable 522, the puff variable 524, and the flight recorder event variable 528. Additional or alternatively, the first nine elements of the hex-digit code 702 may be used to encode additional information about the device 100.

In some embodiments, one or more of the elements of the hex-digit code 702 may be or may represent the capsule variable 522. In some embodiments, the element of the hex-digit code 702 that represents the capsule variable 522 may be a scaled or encoded representation of the capsule variable 522 that can be decoded to determine the total number of capsules used by the device 100. In some embodiments, one or more of the elements of the hex-digit code 702 may be or may represent the flight recorder event variable 528. In some embodiments, the element of the hex-digit code 702 that represents the flight recorder event variable 528 may be a scaled or encoded representation of the flight recorder event variable 528 that can be decoded to determine the total number of flight recorder events in the flight recorder event log 526. In some embodiments, one or more of the elements of the hex-digit code 702 may be or may represent an average number of puffs taken per capsule represented by the puff variable 524. In some embodiments, the element of the hex-digit code 702 that represents the puff variable 524 may be a scaled or encoded representation of the puff variable 524 that can be decoded to determine the average number of puffs taken per capsule.

In some embodiments, one or more of the elements of the hex-digit code 702 may be a data integrity check value such as a checksum. In some embodiments, the data integrity check value may be a binary value that may indicate whether the data is of good quality. If the data is corrupt, the data may not be considered good quality or there may be an issue with one or more metrics being measured by the engagement indicator system 500. In other embodiments, the data integrity check value may be encoded into more than one element of the hex-digit code 702. The data integrity check or the checksum may be a data redundancy check that may be used as a pass/fail feature to determine if a consumer has interpreted and/or read the hex-digit code 702 correctly. The checksum may be a standard cycle redundancy check in some embodiments.

In some embodiments, the last element of the hex-digit code may be an overall indicator of engagement with the device 100. The last element may be a number between 1 and 5 where 1 indicates a low level of engagement with the device and 5 indicates a high level of engagement with the device 100. In some embodiments, the last digit of the hex digit code may be the single digit code 602 described above with reference to FIG. 6.

Figure 7B:
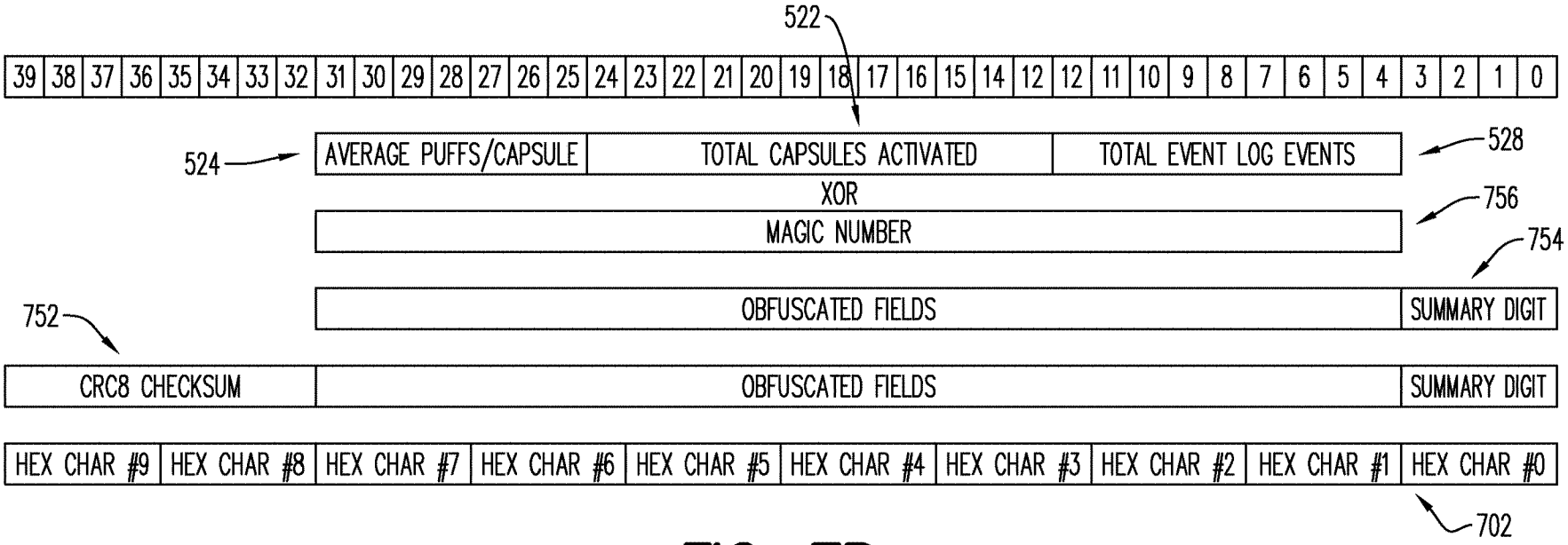
FIG. 7B is a representation of the hex-digit icon of FIG. 7A showing a bit code transition to the hex-digit icon.

Referring to FIG. 7B, the hex-digit code 702 may be calculated or determined from a 40-bit code as shown in process 750. In some embodiments, the data integrity check or checksum 752, the average puffs per capsule or the puff variable 524, the total capsules used or activated or the capsule variable 522, the total events logged in the flight recorder event log 526 or the flight recorder event variable 528, and the overall indicator of engagement with the device 100 or summary digit 754 may be stored in a 40-bit code. In some embodiments, the overall indicator of engagement with the device or the summary digit 754 may be a local summary digit and may be stored in bits 0-3 of the 40-bit code. The flight recorder event variable 528 may be stored in bits 4-12 of the 40-bit code. In some embodiments, the flight recorder event variable 528 may be stored at ×10,000 resolution and may be rounded up such that the flight recorder event variable 528 may have a range of values between 10,000 and 511,000 as stored in the 40-bit code. The capsule variable 522 may be stored in bits 13-24 of the 40-bit code. In some embodiments, the capsule variable 522 may have a range between 0 and 4095. The puff variable 524 may be stored in bits 25-31 of the 40-bit code. In some embodiments, the puff variable 524 may be stored at 0.25 resolution and may have a range of values between 0 and 31.75. The data integrity check or the checksum 752 may be stored in bits 32-39 of the 40-bit code. In some embodiments, the puff variable 524, the capsule variable 522, the flight recorder event variable 528, and the summary digit 754 may be included in the checksum 752.

In some embodiments, the capsule variable 522, the puff variable 524, and the flight recorder event variable 528 may be packed into a 32-bit word as described above. The capsule variable 522, the puff variable 524, and the flight recorder event variable 528 in this 32-bit word may be XORed with a 28-bit constant "Magic Number" 756 in some embodiments. The bits including the capsule variable 522, the puff variable 524, and the flight recorder event variable 528 may be XORed with the Magic Number 756 to create a cipher. This cipher may obfuscate the fields of bits 4-31 of the 32-bit code. For example, this may help to prevent misinterpretations of the capsule variable 522, the puff variable 524, and the flight recorder event variable 528. Once the capsule variable 522, the puff variable 524, and the flight recorder event variable 528 are XORed with the Magic Number 756, the summary digit 754 may be calculated and added to bits 0-3 of the 40-bit code and then the checksum 752 may be calculated and added to bits 32-39 of the 40-bit code. Once each bit of the 40-bit code is determined, the hex-digit code 702 is determined.

In some embodiments, the hex-digit code 702 may be replaced by a machine-readable code such as a QR code. This machine-readable code may be able to be scanned by a device such as a smartphone that may be configured to interpret and/or display one or more metrics encoded by the machine-readable code. In some embodiments, when the machine-readable code is scanned, the metrics encoded by the machine-readable code may additionally be sent to a research facility or to another remote location such as via email.

FIG. 8A shows a chart 800 with an example distribution of consumer data corresponding to a single-digit indication of engagement such as the single digit code 602. The chart 800 may organize data collected from one or more consumer studies that includes a number of capsules used with the device 100, a number of flight recorder events of the device 100, and an average number of puffs taken per capsule. These metrics may be analyzed and the consumers may be categorized or organized and scored based on their engagement with the device 100. The metrics may be scaled and/or organized based on a length of usage as described above. By scaling or organizing the data based on the length of usage of the device 100, consumers who use the device 100 for a certain number of days may be compared to other consumers who use the device 100 for the same number of days. This may enable the data to be organized and analyzed to understand consumer interaction with the device 100.

In some embodiments, if a consumer uses a number of capsules that is in the twentieth percentile or lower of the consumer data, has a total number of flight recorder events in the twentieth percentile or lower of the consumer data, or takes an average number of puffs per capsule that is in the twentieth percentile or lower of the consumer data, the indication of engagement may be considered low and may be scored a "1". If a consumer uses a number of capsules that is between the twenty first percentile and the thirty ninth percentile of the consumer data, has a total number of flight recorder events between the twenty first percentile and the thirty ninth percentile of the consumer data, or takes an average number of puffs per capsule that is between the twenty first percentile and the thirty ninth percentile of the consumer data, the indication of engagement may be scored a "2". If a consumer uses a number of capsules that is between the fortieth percentile and the sixtieth percentile of the consumer data, has a total number of flight recorder events between the fortieth percentile and the sixtieth percentile of the consumer data, or takes an average number of puffs per capsule that is between the fortieth percentile and the sixtieth percentile of the consumer data, the indication of engagement may be considered average and may be scored a "3". If a consumer uses a number of capsules that is between the sixty first percentile and the seventy ninth percentile of the consumer data, has a total number of flight recorder events between the sixty first percentile and the seventy ninth percentile of the consumer data, or takes an average number of puffs per capsule that is between the sixty first percentile and the seventy ninth percentile of the consumer data, the indication of engagement may be scored a "4". If a consumer uses a number of capsules that is in the eightieth percentile or above of the consumer data, has a total number of flight recorder events in the eightieth percentile or above of the consumer data, or takes an average number of puffs per capsule that is in the eightieth percentile or above of the consumer data, the indication of engagement may be considered average and may be considered high and may be scored a "5".

In other embodiments, the percentages may be adjusted, additional metrics may influence the indication of engagement, and/or some metrics may be weighted to have a greater or lesser impact on the indication of engagement with the device 100. For example, in some embodiments, the indication of engagement may be considered low and may be scored a "1" if any of the above described metrics are below the 10th percentile of the consumer data. Additionally, the indication of engagement with the device 100 may be updated and/or adjusted when additional consumer data is acquired. For example, the single digit code 602 and/or the hex-digit code 702 may be adjusted and updated when additional consumer data is acquired.

In some embodiments, the single digit code 602 may be calculated by the processor 502 by the formula: SDC=ROUND((P*0.40)+(C*0.50)+(E*0.1)). SDC may be the single digit code 602, P may be a single digit representation of the average puffs per capsule or the puff variable 524, C may be a single digit representation of the total number of capsules or the capsule variable 522, and E may be a single digit representation of the total number of events logged in the flight recorder event log 526 or the flight recorder event variable 528. As indicated by the formula above, the single digit representation of the average number of puffs per capsule may be given a 40% weight towards the single digit code 602, the single digit representation of the total number of capsules may be weighted 50%, and the single digit representation of the total number of flight recorder events may be weighted 10%.

FIG. 8B shows an example chart 850 of how to determine the single digit representation of the average number of puffs per capsule, the single digit representation of the total number of capsules, and the single digit representation of the total number of flight recorder events.

In some embodiments, the average number of puffs may be given the single digit representation "1" if the average number of puffs per capsule or the puff variable 524 is less than 5. The average number of puffs may be given the single digit representation "2" if the average number of puffs per capsule or the puff variable 524 is less than 8. The average number of puffs may be given the single digit representation "3" if the average number of puffs per capsule or the puff variable 524 is less than 11.75. The average number of puffs may be given the single digit representation "4" if the average number of puffs per capsule or the puff variable 524 is less than 18.25. The average number of puffs may be given the single digit representation "5" if the average number of puffs per capsule or the puff variable 524 is greater than or equal to 18.25.

In some embodiments, the total number of capsules may be given the single digit representation "1" if the total number of capsules or the capsule variable 522 is less than 16. The total number of capsules may be given the single digit representation "2" if the total number of capsules or the capsule variable 522 is less than 25. The total number of capsules may be given the single digit representation "3" if the total number of capsules or the capsule variable 522 is less than 44. The total number of capsules may be given the single digit representation "4" if the total number of capsules or the capsule variable 522 is less than 62. The total number of capsules may be given the single digit representation "5" if the total number of capsules or the capsule variable 522 is greater than or equal to 62.

In some embodiments, the total number of flight recorder events may be given the single digit representation "1" if the total number of flight recorder events or the flight recorder event variable 528 is less than 20000. The total number of flight recorder events may be given the single digit representation "2" if the total number of flight recorder events or the flight recorder event variable 528 is less than 30000. The total number of flight recorder events may be given the single digit representation "3" if the total number of flight recorder events or the flight recorder event variable 528 is less than 50000. The total number of flight recorder events may be given the single digit representation "4" if the total number of flight recorder events or the flight recorder event variable 528 is less than 70000. The total number of flight recorder events may be given the single digit representation "5" if the total number of flight recorder events or the flight recorder event variable 528 is greater than or equal to 70000.

For example, if the puff variable 524 is 9.25, the single digit representation may be "3." If the capsule variable 522 is 62, the single digit representation may be "5." If the flight recorder event variable 528 is 65000, the single digit representation may be "4." Thus, the single digit code 602 may be calculated by the equation SDC=ROUND((3*0.40)+(5*0.50)+(4*0.1)). Thus, the SDC=ROUND(4.10) so the single digit code 602 is "4."

In some embodiments, there may be an additional final check that is performed by the processor 502 to detect unusual behavior. For example, if the puff variable 524 is less than 3.0 and the capsule variable 522 is greater than 10, the engagement indicator system 500 may override the calculation performed by the processor 502 to determine the single digit code 602 and instead determine that the single digit code 602 is "1."

The chart of FIG. 8B is an example of threshold values used to determine the single digit representations for the capsule variable 522, the puff variable 524, and the flight recorder event variable 528. In other embodiments, the threshold values may be different but may be used to categorize a consumer's interaction or engagement with the device 100.

Figure 9:
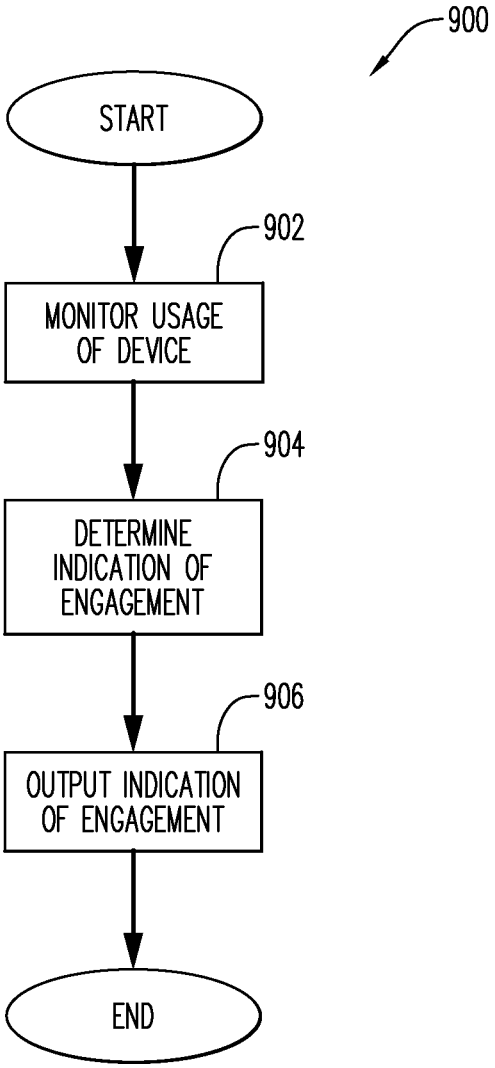
FIG. 9 is a method of operating the engagement indicator system of the device according to an example embodiment.

Referring to FIG. 9, a method 900 of operating the engagement indicator system 500 is shown. The processor 502 is configured to cause the engagement indicator system 500 to perform the method 900 of FIG. 9 by executing instructions stored by the memory 504. In other example embodiments, the processor 502 may be an ASIC and is configured to cause the engagement indicator system 500 to perform the method 900 of FIG. 9. The method 900 may start once a consumer has obtained a device such as the device 100. The method 900 may proceed to step 902 where the engagement indicator system 500 monitors usage of the device 100.

In some embodiments, the engagement indicator system 500 may monitor the usage of the device 100 by monitoring at least a number of capsules used, a number of puffs taken, and a number of flight recorder events. The engagement indicator system 500 may monitor these metrics by monitoring the capsule variable 522, the puff variable 524, and the flight recorder event variable 528.

The method 900 may proceed from the step 902 to step 904 to determine an indication of engagement with the device 100. In some examples, the indication of engagement with the device 100 may be an icon that may be displayed on the communication screen 136 by the processor 502. The indication of engagement with the device 100 may be determined based on the metrics that are monitored at the step 902 to monitor the usage of the device 100. In some embodiments, the indication of engagement with the device 100 may be a single digit code representative of an overall engagement with the device 100 such as the single digit code 602. In other embodiments, the indication of engagement with the device 100 may be a hex-digit code such as the hex-digit code 702. Both the single digit code 602 and the hex-digit code 702 may be determined substantially as described above with reference to FIGS. 6-8.

After the indication of engagement is determined at the step 904, the method 900 may proceed to step 906 where the processor 502 outputs the indication of engagement determined at the step 904. As described above, the indication of engagement with the device 100 may be an icon such as the single digit code 602 or the hex-digit code 702 that may be output on the communication screen 136 of the device 100.

In some embodiments, the icon may be displayed after a specific interaction with the device 100. For example, the icon may be displayed after the control button 138 is pressed, the lid 104 is opened and closed while the control button 138 is pressed, and the control button 138 is released. In some embodiments, the interaction with the device 100 may be a different sequence of events that may display either the single digit code 602 or the hex-digit code 702 on the communication screen 136.

In some embodiments, the device 100 may be programmed to display either the single digit code or the hex-digit code when the control button 138 is pressed, the lid 104 is opened and closed while the control button 138 is pressed, and the control button 138 is released.

Figure 10:
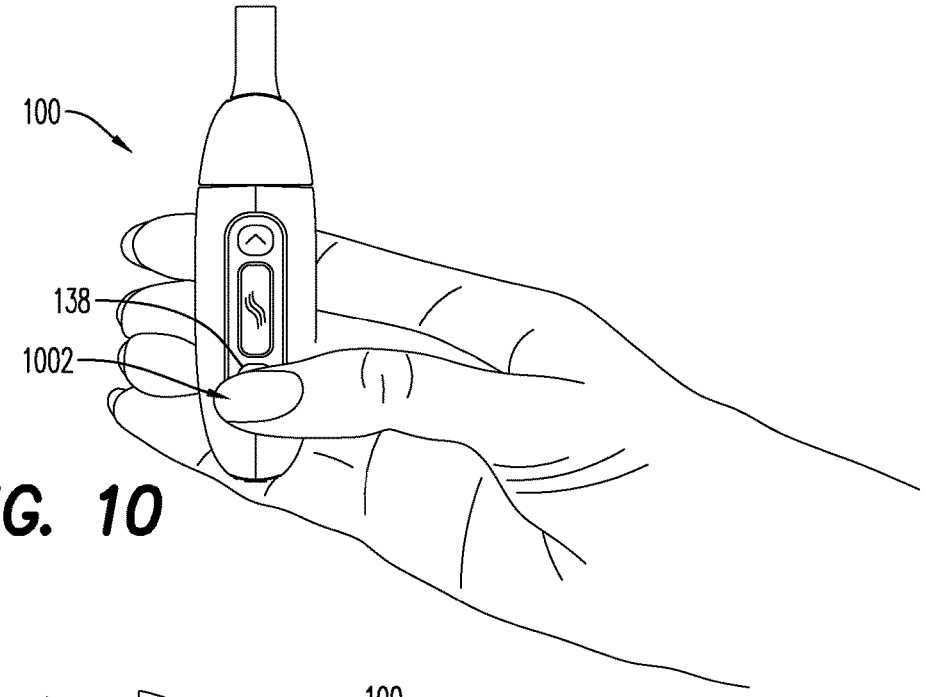
FIG. 10 is a first step of a method of interacting with the device to display an icon representing the indication of engagement with the device according to an example embodiment.
Figure 11:
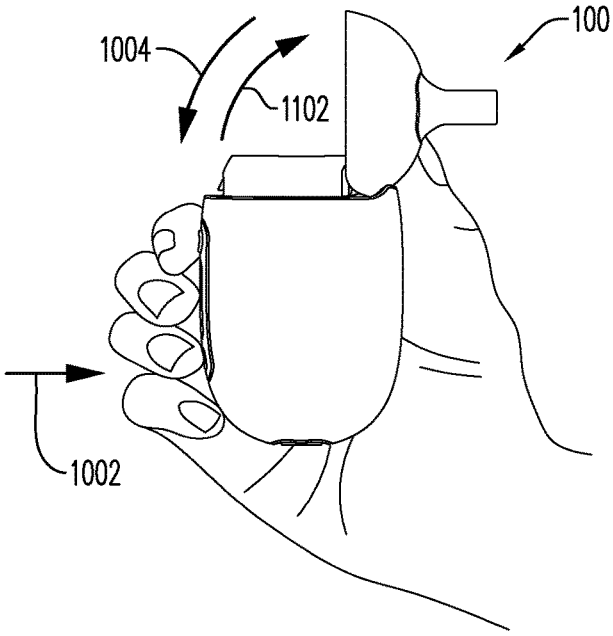
FIG. 11 is a second step of a method of interacting with the device to display an icon representing the indication of engagement with the device according to an example embodiment.
Figure 12:
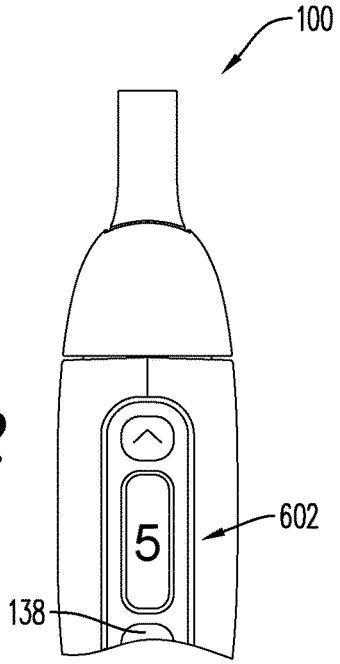
FIG. 12 is a third step of a method of interacting with the device to display an icon representing the indication of engagement with the device according to an example embodiment.

Referring to FIGS. 10-12, a process or method of interacting with the device 100 in order to display an icon representing an indication of engagement with the device 100 is shown. As shown in FIG. 10, the first step or device interaction may be pressing the control button 138. Arrow 1002 may represent the force pushing the control button 138. In some embodiments, the control button 138 may be depressed for the entirety of the interaction with the device 100 in order to display the indication of engagement with the device 100.

While the control button 138 is depressed, the lid 104 of the device 100 may be opened as represented by arrow 1102. Then the lid 104 of the device 100 may be closed as represented by arrow 1104. The control button 138 may remain depressed while the lid 104 is opened and closed.

After the lid 104 is closed, the control button 138 may be released which may cause an indication of engagement such as the single digit code 602 or the hex-digit code 702 to appear on the communication screen 136 of the device 100. As shown in FIG. 12, the icon may appear on the communication screen 136. As described above, the device 100 may be pre-programmed to either display the single digit code 602 or the hex-digit code 702 after this interaction with the device 100.

In some embodiments, the device 100 can additionally include an irreversible fuse. In some embodiments, the irreversible fuse may be an element of the processor 502 or may be communicatively coupled with the processor 502. When the irreversible fuse is blown, the engagement indicator system 500 may no longer calculate and/or store the capsule variable 522, the puff variable 524, and the flight recorder event variable 528 and may no longer calculate the single digit code 602 or the hex-digit code 702.

The systems, apparatuses, and methods described herein may provide significant advantages. The icon describing an indication of engagement with the device 100 may be displayed by a consumer and may enable real time, accurate feedback about a consumer's engagement with the device 100. The indication of engagement with the device 100 may additionally reduce the burden of in-person interviewing for consumer studies while providing the same or more detailed level of insights into product usage. The indication of engagement with the device 100 may improve consumer studies by providing a quantitative measure of usage of the device 100 which can be used with qualitative statements by consumers to determine a more accurate indication of engagement than without the quantitative measure.

The appended claims set forth novel and inventive aspects of the subject matter described above, but the claims may also encompass additional subject matter not specifically recited in detail. For example, certain features, elements, or aspects may be omitted from the claims if not necessary to distinguish the novel and inventive features from what is already known to a person having ordinary skill in the art. Features, elements, and aspects described in the context of some embodiments may also be omitted, combined, or replaced by alternative features serving the same, equivalent, or similar purpose without departing from the scope of the invention defined by the appended claims.

What is claimed is:

1. A system configured to output an indication of engagement with a device, the system comprising:

at least one processor; and a memory coupled to the at least one processor and storing instructions, the at least one processor configured to execute the instructions to cause the system to, obtain information associated with usage of the device, determine the indication of engagement with the device based on the usage of the device, and output the indication of engagement with the device on a communication screen of the device in response to detecting a multi-step interaction with the device, the multi-step interaction with the device including at least one action with respect to a button of the device and at least one action with respect to a lid of the device, wherein the at least one action with respect to the lid of the device occurs during the at least one action with respect to the button of the device.

2. The system of claim 1, wherein the indication of engagement with the device comprises a hex-digit indicator.

3. The system of claim 2, wherein the hex-digit indicator comprises two rows of five hex digits.

4. The system of claim 2, wherein the hex-digit indicator encodes at least one of a number of capsules used, an average number of puffs per capsule, an exact number of flight recorder events, or a data integrity check.

5. The system of claim 2, wherein a last element of the hex-digit indicator is a single digit.

6. The system of claim 5, wherein the single digit represents an overall engagement with the device.

7. The system of claim 1, wherein the at least one processor is configured to execute the instructions to cause the device to output a hex-digit indicator in response to the multi-step interaction with the device.

8. The system of claim 1, wherein the multi-step interaction with the device comprises holding the button of the device, opening the lid of the device while the button is being held, closing the lid of the device while the button is being held, and releasing the button.

9. The system of claim 1, wherein the indication of engagement with the device comprises a single digit code.

10. The system of claim 9, wherein the single digit code is a last digit of a hex-digit indicator.

11. The system of claim 9, wherein the single digit code represents an overall engagement with the device.

12. The system of claim 11, wherein the at least one processor is configured to determine the overall engagement with the device based on at least one of a number of capsules used, an average number of puffs per capsule, or an exact number of flight recorder events.

13. The system of claim 9, wherein the at least one processor is configured to execute the instructions to cause the device to output the single digit code on the communication screen of the device.

14. The system of claim 13, wherein the at least one processor is configured to execute the instructions to cause the device to output the single digit code on the communication screen of the device in response to the multi-step interaction with the device.

15. The system of claim 14, wherein the multi-step interaction with the device comprises holding the button of the device, opening the lid of the device while the button is being held, closing the lid of the device while the button is being held, and releasing the button.

16. The system of claim 9, wherein the single digit code is a digit between one and five.

17. The system of claim 1, wherein the at least one processor is configured to execute the instructions to adjust the indication of engagement with the device as additional data is gathered by the system.

18. The system of claim 1, wherein the at least one processor is configured to execute the instructions to scale the indication of engagement with the device to a length of usage.

19. The system of claim 18, wherein the length of usage is at least one of two-day usage or seven-day usage.

* * * * *